United States Patent [19]

Nigol et al.

[11] Patent Number: 4,673,775

[45] Date of Patent: Jun. 16, 1987

[54] LOW-LOSS AND LOW-TORQUE ACSR CONDUCTORS

[76] Inventors: Olaf Nigol, 272 Markland Drive, Toronto, Ontario, Canada, M9C 1R7; John S. Barrett, R.R. #8, Orangeville, Ontario, Canada, L9W 3T5; Martin A. Green, 49 Hunting Ridge, Etobicoke, Ontario, Canada, M9R 1C1

[21] Appl. No.: 848,758

[22] Filed: Apr. 7, 1986

[51] Int. Cl.[4] ..... H01B 5/10

[52] U.S. Cl. ..... 174/130; 174/128 R; 174/131 R

[58] Field of Search ..... 174/128 R, 130, 131 R; 57/200, 204

[56] References Cited

U.S. PATENT DOCUMENTS

| | | | |
|---|---|---|---|
| 1,919,509 | 7/1933 | Grobl | 174/128 R |
| 3,231,665 | 1/1966 | Grimes, Jr. et al. | 174/128 R |
| 3,445,586 | 5/1969 | Edwards et al. | 174/130 |
| 3,760,093 | 9/1973 | Pemberton | 174/130 X |
| 3,813,481 | 5/1974 | Adams | 174/128 R X |
| 4,436,954 | 3/1984 | Kaderjak et al. | 174/128 R |

FOREIGN PATENT DOCUMENTS

| | | | |
|---|---|---|---|
| 819820 | 4/1981 | U.S.S.R. | 174/130 |

*Primary Examiner*—Morris H. Nimmo
*Attorney, Agent, or Firm*—Ridout & Maybee

[57] ABSTRACT

The invention relates to ACSR conductors having two or more layers of conductor strands wound helically around a steel core, the layers being wound alternately in right-handed and left-handed helices. The AC/DC resistance ratio of such a conductor can be greatly reduced by appropriate selection of the lay factors of the strand layers in relation to the cross sectional areas of the respective layers. The unbalanced mechanical torque can also be greatly reduced by appropriate selection of the lay factors of the strand layers in relation to the means diameters of the layers and the outside diameter of the conductor.

11 Claims, 9 Drawing Figures

LOW-LOSS AND LOW-TORQUE ACSR CONDUCTORS

This invention relates to ACSR (Aluminum Conductor Steel Reinforced) conductors.

An ACSR conductor typically comprises one or more layers of aluminum conductor strands which are helically wound around a steel core. The aluminum strands, which are of electrical grade aluminum, aluminum alloy, or a mixture of aluminum alloys, may be round in cross section, in which case the conductor is referred to as "Standard ACSR", or may be trapezoidal in cross section, in which case the conductor is referred to as "Compact ACSR". The present invention is particularly concerned with ACSR conductors in which there are two or more layers of helically wound aluminum conductor strands.

An electrical problem which arises with ACSR conductors is that the current, which follows the helical windings of the conductor strands, magnetizes the steel core and thereby increases the AC/DC resistance ratio. The increase is due to magnetic losses, i.e. hysteresis and eddy current losses, and ohmic losses due to currents induced in the conductor strands.

It is an object of the present invention to provide an ACSR conductor configuration whereby both magnetic losses and ohmic losses can be substantially reduced. This is achieved, in a multilayer ACSR conductor, by configuring the layers of conductor strands so as to balance the axial magnetic fields produced in the steel core.

Thus, according to the present invention, in an ACSR conductor having a plurality (n) of layers of aluminum conductor strands helically wound around a steel core, the layers being wound alternately in right-handed and left-handed helices, the lay lengths and conductor cross sectional areas of the layers are such that $$\left| \sum_{i=1}^{n} \frac{A_i}{l_i} \right| \leqq .25 \text{ mm.}$$

where $A_i$ is the conductor cross sectional area in square millimeters, $l_i$ is the lay length in millimeters, of a respective layer i, $l_i$ being positive for a right-handed helically wound layer and negative for left-handed helically wound layer, and the symbol $\Sigma$ indicates summation.

In an ideal case the conductor cross sectional areas and lay lengths of the layers would be such that $$\left| \sum_{i=1}^{n} \frac{A_i}{l_i} \right| = 0$$

However, it has been found from experimental data that the advantage of the invention will be realized if this resultant does not exceed 0.25 mm. In the case of a two-layer ASCR conductor in which the conductor cross sectional areas are $A_1$, $A_2$, respectively and the lay lengths are $\mathbf{1}_1$, $\mathbf{1}_2$ respectively, it is especially preferable that these values be such that $$\left| \frac{A_1}{l_1} + \frac{A_2}{l_2} \right| \leqq .10 \text{ mm.}$$

Present ACSR conductors also give rise to the problem of unbalanced torque which tends to twist the conductor as tension is applied to it. According to the present invention, this problem can be largely overcome, in the case of a multilayer ACSR conductor, by arranging the cross sectional areas, the lay angles, and the mean diameters, of the layers to be such that the magnitude of unbalanced torque, measured in units of $mm._3$, is less than or equal to 1.5 times the cube of the conductor diameter, measured in millimeters. That is to say $$\left| 100 \sum_{i=1}^{n} \frac{A_i D_i}{2} \cdot \cos^2\theta_i \sin\theta_i \right| \leqq 1.5\, d^3$$

where n is the number of layers of conductor strands, $A_i$ is the cross sectional area of a respective layer i in square millimeters, $D_i$ is the arithmetic mean diameter of the layer i in millimeters, $\theta_i$ is the lay angle of the layer i, being positive for right-handed helices and negative for left-handed helices, and d is the conductor diameter in millimetres.

In the case of an ACSR conductor having three or more layers of conductor strands, the magnitude of the unbalanced torque can be advantageously reduced to a value less than or equal to the cube of the conductor diameter in millimeters.

Exemplary embodiments of the invention will now be described with reference to the accompanying drawings, in which, FIG. 1 illustrates a fragment of a two-layer ACSR conductor;

Figure 7:
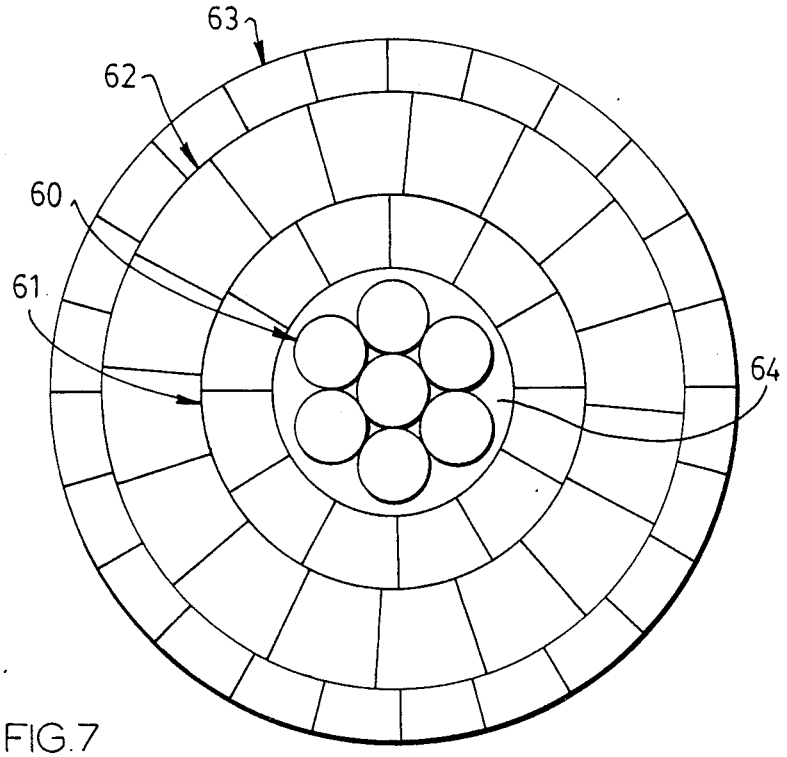

FIG. 7.is an end view of yet another modified three-layer ACSR conductor.

Figure 8:
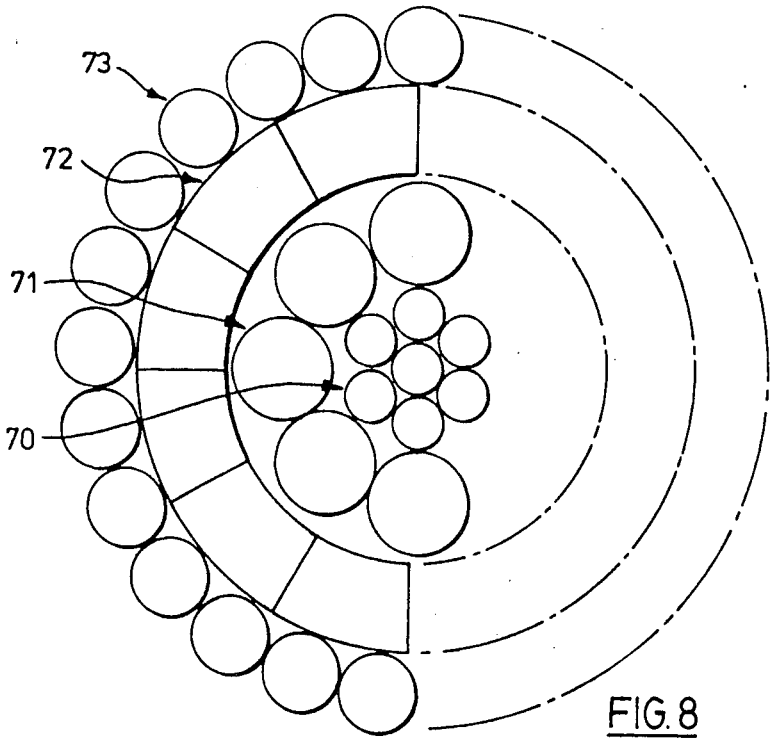
Figure 9:
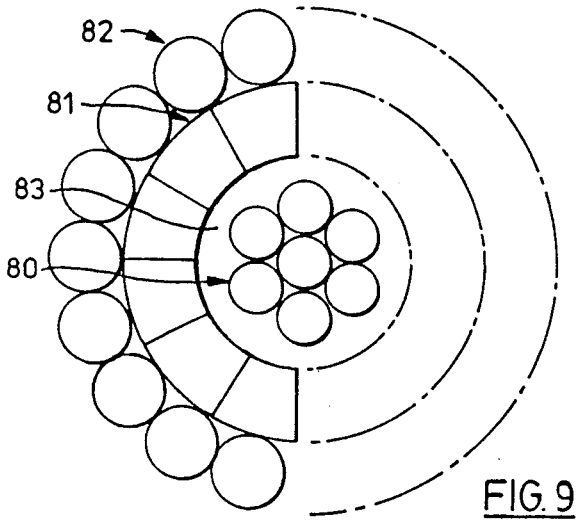

FIG. 8 is an end view of yet another modified three layer ACSR conductor; and FIG. 9 is an end view of a modified two layer ACSR conductor.

Figure 1:
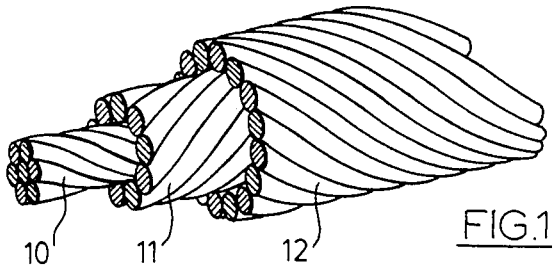

ACSR conductor shown in FIG. 1 comprises a stranded steel core 10, an inner layer of aluminum conductor strands 11 helically wound around the core, and an outer layer of aluminum conductor strands 12 helically wound in the opposite direction. In such a conductor, in which the layers of helically wound strands are of opposite hand, the resultant axial magnetic field in the steel core 10 is a function of the current carried by the conductor, the distribution of current density over the conductor cross section, and the configurations of the helically wound strands. This can be calculated in the manner described below, which is valid for all such conductors having two or more layers of aluminum strands.

The voltage drop V per unit length of conductor has the same value for all layers since they are in parallel. For any layer i, this voltage drop, neglecting skin effect and the slight increase in wire length due to stranding, is given by:

$$\frac{rI_i}{A_i} + (j\omega\mu a)\frac{H}{l_i} \tag{1}$$

where r=resistivity of aluminum or aluminum alloy of the strands;

$I_i$=current in layer i $A_i$=cross sectional area of layer i $\omega$=2 $\pi$to times the frequency (60 Hz)

$\mu$=magnetic permeability of the steel core a=cross sectional area of the steel core H=axial magnetic field in the steel core $l_i$=lay length (pitch) of layer i, (where $l_i>0$ for a right-handed helix, and $l_i<0$ for a left-handed helix)

The axial magnetic field H in the steel core is given by:

$$H = \sum_{i=1}^{n} \frac{I_i}{l_i} \tag{2}$$

where n indicates the number of layers, and the symbol indicates summation.

The first term of equation (1) is the voltage drop due to resistivity of the aluminum and the second term is the inductive voltage drop resulting from the axial magnetic field H in the core. If the conductor is arranged to be magnetically balanced, i.e. H=0, equation (1) reduces to:

$$V = \frac{rI_1}{A_1} = \frac{rI_2}{A_2} = \frac{rI_3}{A_3} \tag{3}$$

This indicates that the current density I/A is a constant for all the strand layers. In other words Ii is proportional to $A_i$ and equation (2) reduces to:

$$\sum_{i=1}^{n} \frac{A_i}{l_i} = 0 \tag{4}$$

where $l_i>0$ for a right-handed helix, and $l_i<0$ for a left-handed helix.

If a conductor is constructed according to equation (4), the current density at power frequencies such as 25 Hz, 50 Hz, and 60 Hz will be uniform (except for a slight non-uniformity caused by skin effect) and thus the ohmic losses of the conductor will be minimized. In addition, the axial magnetic field will be zero thus eliminating magnetic losses in the steel core.

A practical formula for calculating the axial magnetic field for a typical current density of 1 A/mm$^2$ is given by:

$$H = \sum_{i=1}^{n} \frac{A_i}{l_i} \tag{5}$$

where

H is a measure of the magnetic field in millimeters the actual magnitude of H in Amperes/millimeters corresponding to its value for a uniform current density of b 1 A/mm$^2$.

$A_i$ is the conductor cross sectional area of a respective layer i in mm$^2$.

$l_i$ is the lay length (pitch) in mm of the respective layer i ($l_i>0$ for a right-handed helix)

($l_i<0$ for a left-handed helix)

In the case of a two-layer conductor, shown in FIG. 1, in which the helically wound inner layer has a conductor cross sectional area $A_1$ and a lay length $l_1$, ($l_1<0$), and in which the outer layer wound in the opposite direction has a conductor cross sectional area $A_2$ and a lay length $l_2$ ($l_2>0$), the axial magnetic field H is given by $$H = \frac{A_1}{l_1} + \frac{A_2}{l_2} \tag{6}$$

Equation (5) means that for each layer the conductor crosssectional area of the layer is divided by the lay length. The results for all the layers are then added together. The resulting value of axial magnetic field H can be controlled in practice by adjusting either the lay lengths of the different layers, or the wire size of the different layers, or by a combination of both methods. Examples will be given hereinafter but first the problem of balancing the mechanical torque of the conductors will be discussed.

Figure 2:
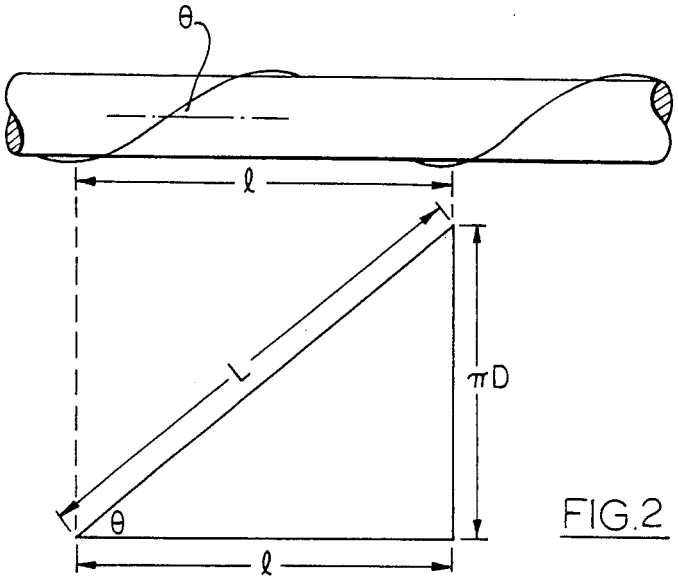
FIG. 2 is a diagram illustrating the geometry of one conductor strand.

FIG. 2 illustrates the helical geometry of a single conductor strand of an ACSR conductor. The geometry is defined by the following parameters:

l is the lay length (pitch) of the strand in a given layer

D is the mean diameter of the layer

L is the length of strand in one lay length $\theta$ is the lay angle where $\theta$=arctan ( $D/l$)

From FIG. 2 it can be seen that $$L = \sqrt{l^2 + (\pi D)^2} \tag{7}$$

When axial tension is applied to the conductor the strand stretches and both L and l increase. From equation (7), the strand strain (fractional change in L) is related to the conductor strain (fractional change in axial length l) by $$e_L = \frac{\Delta L}{L} = \frac{l^2}{L^2} \times \frac{\Delta l}{l} = (\cos^2\theta)e_x \tag{8}$$

where $e_L$ is strand strain, and $e_x$ is the axial conductor strain

The lay angle $\theta$ shown in FIG. 2 is given by:

$$\theta = \arctan(\pi D/l) \tag{9}$$

The sum of the strand tensions $T_i$ in a layer i (in the helical direction) is given by:

$$T_i = A_i E e_L = A_i E e_x \cos^2\theta_i \quad (10)$$

where $A_i$ is the cross sectional area of layer i, and

E is the elastic modulus of the aluminum of the strands.

The layer torque is then given by:

$$T_i(D_i/2)\sin\theta_i = (Ee_x)\left(\frac{A_i D_i}{2}\cos^2\theta_i \sin\theta_i\right) \quad (11)$$

where $\theta_i$ is positive for a right-handed helix and negative for a left-handed helix.

In order to produce a practical formula for torque, $Ee_x$ is set to 100 MPa which corresponds approximately to the tensile stress on the strand that would occur at 50% of the rated tensile strength of an ACSR conductor. A measure of the total unbalanced torque of the conductor, in millimeters cubed, corresponding to the actual torque unbalance in Newton-millimeters that occurs when an axial stress of 100 MPa is applied to the conductor, is given by:

$$100 \sum_{i=1}^{n} \frac{A_i D_i}{2} \cos^2\theta_i \sin\theta_i \quad (12)$$

where $A_i$ is the cross sectional area of layer i in $mm^2$ $D_i$ is the mean diameter of layer i in mm $\theta_i$ is the lay angle of layer i, positive for a right-handed helix and negative for a left-handed helix.

The unbalanced torque of the conductor as given by expression (12) can be balanced, or made very small, by adjusting the lay lengths of the different layers, or by adjusting the sizes of the strands in the different layers. A combination of both methods may also be used.

EXAMPLE 1

The first example relates to a common design of ACSR conductor having the general configuration shown in FIG. 1. This is the commonly used two-layer 795 kcmil (26/7) ACSR "Drake" conductor. The electrical and mechanical properties of the conductor are determined by the configurations of the inner and outer layers of conductor strands, which are defined as follows:

| | | |
|---|---|---|
| Inner Layer of Strands | | |
| ($A_1$) cross sectional area | 155 | sq. mm. |
| ($D_1$) mean diameter of layer | 14.8 | mm. |
| ($l_1$) lay length | −269.6 | mm. (L.H. helix) |
| ($\theta_1$) lay angle | −9.79 | degrees |
| Outer Layer of Strands | | |
| ($A_2$) cross sectional area | 248 | sq. mm. |
| ($D_2$) mean diameter of layer | 23.68 | mm. |
| ($l_2$) lay length | 323.6 | mm (R.H. helix) |
| ($\theta_2$) lay angle | 12.95 | degrees |
| (d) conductor outside diameter | 28.14 | mm. |

The wire diameter in each layer is 4.44 mm.

It follows from the theoretical considerations discussed previously that the resultant axial magnetic field in the steel core will be given by $$H = \frac{A_1}{l_1} + \frac{A_2}{l_2} = .191 \text{ mm.}$$

The unbalanced torque, computed from expression (12), is 1.96 times the cube of the conductor diameter (d). This is fairly large and results in approximately one twist of the conductor per meter at normal stringing conditions.

EXAMPLE 2

The conductor of the second example differs from that of the first only in that the lay lengths of the strand layers have been modified in accordance with the present invention. Thus, the lay lengths of the inner and outer strand layers have been changed to −246.3 mm. and 394 mm. respectively, the lay angles being −10.69 degrees and 10.69 degrees, respectively. With this modification the resultant axial magnetic field in the steel core is practically eliminated:

$$H = \frac{A_1}{l_1} + \frac{A_2}{l_2} = .0001 \text{ mm.}$$

Furthermore, with this modification, the unbalanced torque is reduced by 26% to 1.44 times the cube of the conductor diameter.

EXAMPLE 3

Figure 3:
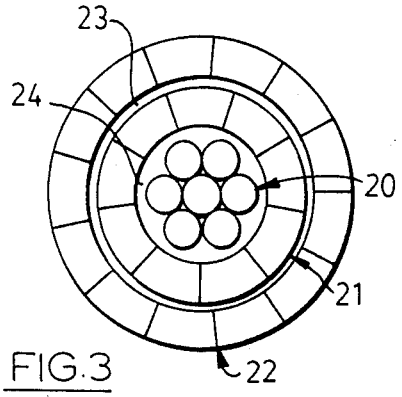
FIG. 3 is an end view of a two-layer self-damping ACSR conductor.

The third example relates to a two-layer self-damping ACSR conductor having the configuration shown in cross section in FIG. 3. The conductor strands of the inner layer 21, and the conductor strands of the outer layer 22, are of trapezoidal cross section and are wound in left-handed and right-handed helices, respectively, around a stranded steel core 20. To achieve self-damping, a clearance 23 is left between the inner and outer strand layers, and a clearance 24 is left between the inner strand layer and the steel core 20.

In a commonly used design of ACSR conductor having this general configuration, the geometry of the inner and outer layers of strands is defined by the following parameters:

| | | |
|---|---|---|
| Inner Layer of Strands | | |
| ($A_1$) cross sectional area | 132 | sq. mm. |
| ($D_1$) mean diameter of layer | 14.0 | mm. |
| ($l_1$) lay length | −204 | mm. |
| ($0_1$) lay angle | −12.17 | degrees |
| Outer Layer of Strands | | |
| ($A_2$) cross sectional area | 207 | sq. mm. |
| ($D_2$) mean diameter of layer | 22.0 | mm. |
| ($l_2$) lay length | 264 | mm. |
| ($0_2$) lay angle | 14.67 | degrees |
| (d) conductor diameter | 25 | mm. |

The thickness of each layer is 3.0 mm.

With this design the resultant axial magnetic field in the steel core will be given by $$H = \frac{A_1}{l_1} + \frac{A_2}{l_2} = .139\ A/\text{mm.}$$

Furthermore, the unbalanced torque is unacceptably high, being 2.27 times the cube of the conductor diameter.

EXAMPLE 4

Figure 4:
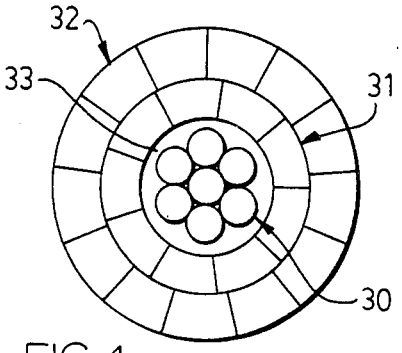
FIG. 4 is an end view of an improved two-layer self-damping ACSR conductor.

In the greatly improved design of two-layer self-damping ACSR conductor illustrated in FIG. 4, the conductor strands of the inner layer 31 are helically wound in a left-handed direction around the stranded steel core 30, leaving a clearance 33 whereby the self-damping properties of the conductor are obtained, and the conductor strands of the outer layer 32 are helically wound in the opposite direction around the inner layer 31, leaving no clearance between the layers. The conductor strands, as in Example 3, are of trapezoidal cross section.

The geometry of the ACSR conductor is defined by the following parameters:

| | | |
|---|---|---|
| Inner Layer of Strands | | |
| ($A_1$) cross sectional area | 159.4 | sq. mm. |
| ($D_1$) mean diameter of layer | 14.5 | mm. |
| ($l_1$) lay length | −236 | mm. |
| ($0_1$) lay angle | −10.93 | degrees |
| Outer Layer of Strands | | |
| ($A_2$) cross sectional area | 236.4 | sq. mm. |
| ($D_2$) mean diameter of layer | 21.5 | mm. |
| ($l_2$) lay length | 350 | mm. |
| ($0_2$) lay angle | 10.93 | degrees |
| (d) conductor outside diameter | 25 | mm. |

The thickness of each layer is 3.5 mm.

In the case of this conductor the resultant axial magnetic field in the steel core will be given by $$H = \frac{A_1}{l_1} + \frac{A_2}{l_2} = O$$

The axial magnetic field is practically eliminated.

Furthermore, the unbalanced torque, computed from expression (12) has been reduced to 1.62 times the cube of the conductor diameter.

EXAMPLE 5

Figure 5:
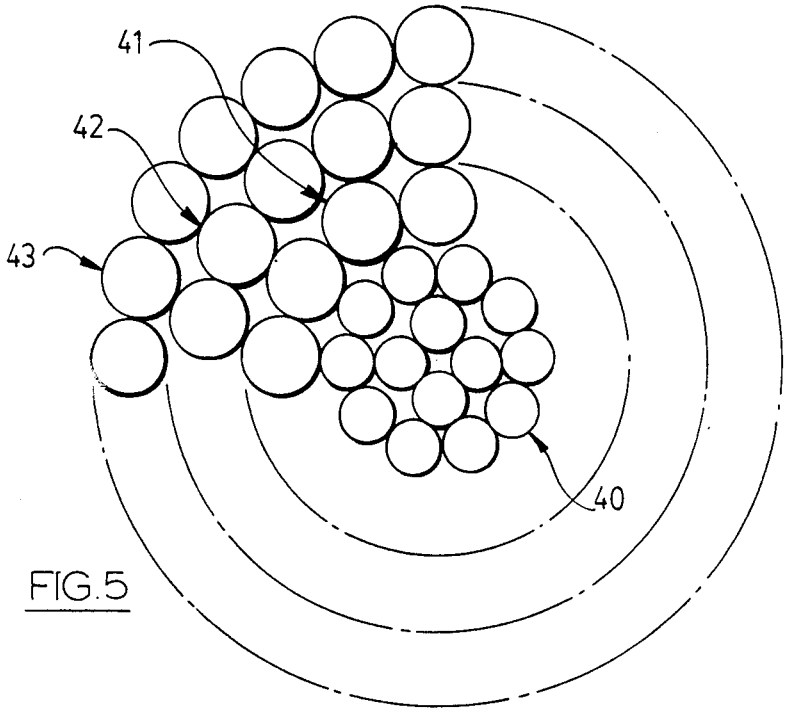
FIG. 5 is an end view of a three-layer ACSR conductor.

FIG. 5 illustrates in cross section a three-layer ACSR conductor in which the conductor strands of the three layers are of round cross section, the strands of each layer being wound helically around a stranded steel core 40. The layers are of the same radial thickness, the strands all being of the same diameter. The conductor strands of the innermost layer 41, and of the outermost layer 43 are wound in right-handed helices, while the strands of the middle layer 42 are wound in left-handed helices. The conductor geometry is defined by the following parameters:

| | | |
|---|---|---|
| Innermost Layer of Strands | | |
| ($A_1$) cross sectional area | 89.5 | sq. mm. |
| ($D_1$) mean diameter of layer | 12.33 | mm. |
| ($l_1$) lay length | 206.5 | mm. |
| ($\theta_1$) lay angle | 10.62 | degrees |
| Middle Layer of Strands | | |
| ($A_1$) cross sectional area | 134.3 | sq. mm. |
| ($D_1$) mean diameter of layer | 18.49 | mm. |
| ($l_1$) lay length | −248.1 | mm. |
| ($\theta_2$) lay angle | −13.18 | degrees |
| Outermost Layer of Strands | | |
| ($A_3$) cross sectional area | 179.0 | sq. mm. |
| ($D_3$) mean diameter of layer | 24.66 | mm. |
| ($l_3$) lay length | 305 | mm. |
| ($\theta_3$) lay angle | 14.25 | degrees |
| (d) conductor diameter | 27.73 | mm. |

The wire diameter in each layer is 3.08 mm.

With this design, which is commonly used in the art, the resultant axial magnetic field in the steel core will be given by $$H = \frac{A_1}{l_1} + \frac{A_2}{l_2} + \frac{A_3}{l_3} = .48 \text{ mm.}$$

Furthermore, the unbalanced torque is 1.59 times the cube of the conductor diameter.

EXAMPLE 6

In this example, a three-layer ACSR conductor according to the present invention has the configuration illustrated in FIG. 5, and differs from the ACSR conductor of the preceding example only in the configurations of the three layers of conductor strands. Thus, the only geometric parameters which differ from those of the preceding example are the following:

| | | |
|---|---|---|
| Innermost Layer of Strands | | |
| ($l_1$) lay length | 246.6 | mm. |
| ($\theta_1$) lay angle | 8.93 | degrees |
| Middle Layer of Strands | | |
| ($l_2$) lay length | −215.7 | mm. |
| ($\theta_2$) lay angle | −15.07 | degrees |
| Outermost Layer of Strands | | |
| ($l_3$) lay length | 388.2 | mm. |
| ($\theta_3$) lay angle | 11.29 | degrees |

With this design the resultant axial magnetic field in the steel core will be given by $$H = \frac{A_1}{l_1} + \frac{A_2}{l_2} + \frac{A_3}{l_3} = .201 \text{ mm.}$$

This example shows that the resultant axial magnetic field can be reduced by as much as 58% merely by changing the lay lengths within limits set by conductor standards. Furthermore, the unbalanced torque is reduced to 0.93 times the cube of the conductor diameter.

EXAMPLE 7

The present example illustrates how the magnetic and mechanical properties of a three-layer ACSR conductor having the configuration shown in FIG. 5 can be improved spectacularly merely by modifying the lay factors of the strand layers. In this example, using the same symbols as in the two preceding examples, the geometric parameters are as follows:

| | | |
|---|---|---|
| ($A_1$) | 89.5 | sq. mm. |
| ($D_1$) | 12.33 | mm. |
| ($l_1$) | 308.2 | mm. |
| ($\theta_1$) | 7.16 | degrees |
| ($A_2$) | 134.3 | sq. mm. |
| ($D_2$) | 18.49 | mm. |
| ($l_2$) | −218.9 | mm. |
| ($\theta_2$) | −14.86 | degrees |
| ($A_3$) | 179.0 | sq. mm. |
| ($D_3$) | 24.66 | mm. |
| ($l_3$) | 554.6 | mm. |
| ($\theta_3$) | 7.95 | degrees |
| (d) | 27.73 | mm. |

The wire diameter in each layer is 3.08 mm.

In this design the resultant axial magnetic field is practically eliminated. Thus $$H = \frac{A_1}{l_1} + \frac{A_2}{l_2} + \frac{A_3}{l_3} = -.0004 \text{ mm.}$$

Furthermore, the unbalanced torque is reduced by a factor 5, as compared with the conventional design of Example 5, to 0.33 times the cube of the conductor diameter.

EXAMPLE 8

Figure 6:
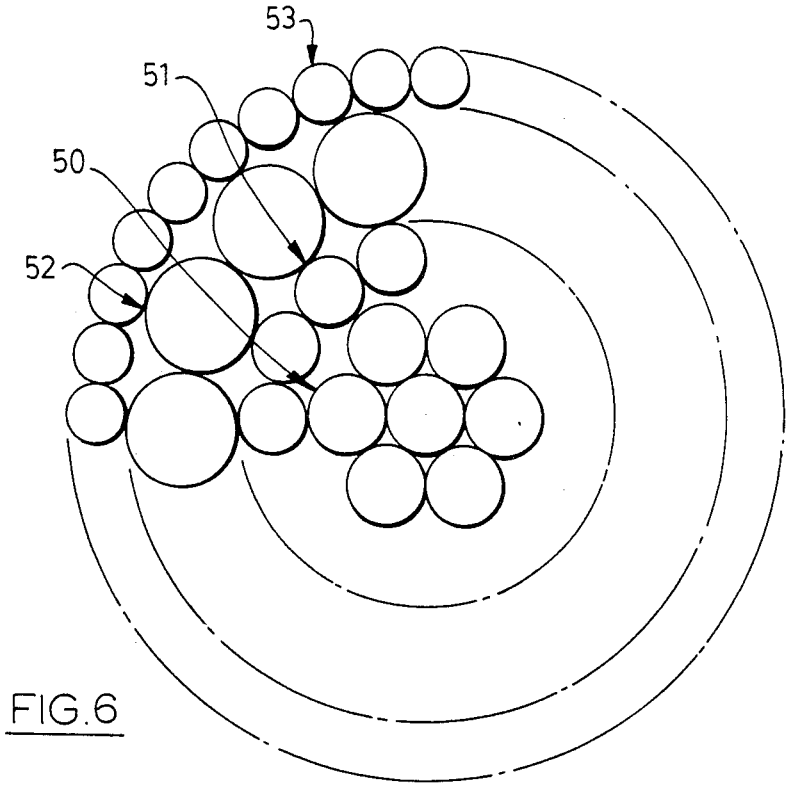
FIG. 6 is an end view of a modified three-layer ACSR conductor.

FIG. 6 illustrates another three-layer ACSR conductor in which the conductor strands of the three layers are of round cross section but are of different diameters so that the radial thicknesses of the layers differ by more than 10%. By appropriately selecting the diameters of the conductor s rands as well as the lay factors of the layers, one can practically eliminate both the axial magnetic field in the steel core and the unbalanced torque at the same time.

In FIG. 6 layers of conductor strands are wound helically around a stranded steel core 50. The inner layer of strands 51 and the outermost layer of strands 53 are wound with right-handed helices, while the strands of the middle layer 52 are wound in a left-handed helix. The wire diameters in the innermost, middle and outermost layers are 2.77 mm., 4.44 mm. and 2.16 mm., respectively.

The geometry of the conductor is defined by the following parameters, using the same symbols as have been used in the preceding examples:

| | | |
|---|---|---|
| ($A_1$) | 78.6 | sq. mm. |
| ($D_1$) | 12.02 | mm. |
| ($l_1$) | 185.3 | mm. |
| ($\theta_1$) | 11.51 | degrees |
| ($A_2$) | 201.1 | sq. mm. |
| ($D_2$) | 19.23 | mm. |
| ($l_2$) | −253.5 | mm. |
| ($\theta_2$) | −13.40 | degrees |
| ($A_3$) | 131.6 | sq. mm. |
| ($D_3$) | 25.83 | mm. |
| ($l_3$) | 381.2 | mm. |
| ($\theta_3$) | 12.02 | degrees |
| (d) | 27.99 | mm. |

Applying the formulae discussed previously, one finds that for this conductor the resultant axial magnetic field in the steel core is given by $$H = \frac{A_1}{l_1} + \frac{A_2}{l_2} + \frac{A_3}{l_3} = .024 \text{ mm.}$$

Furthermore, the unbalanced torque has been reduced to a mere 0.03 times the cube of the conductor diameter.

EXAMPLE 9

This example further illustrates the principle employed in the preceding example, wherein both axial magnetic field and unbalanced torque are practically eliminated by appropriate selection of strand diameters for the respective layers, as well as the lay factors of the respective layers. In the present example, however, the conductor is a self-damping ACSR conductor with conductor strands of trapezoidal cross section.

Referring to FIG. 7, the ACSR conductor comprises an inner layer 61, a middle layer 62, and an outermost layer 63, of aluminum conductor strands of trapezoidal cross section. The wire thicknesses in the three layers are 3.08 mm., 4.01 mm. and 2.16 mm., respecrively. The layers are wound helically around a stranded steel core 60, leaving a clearance 64 between the core 60 and the innermost layer of strands 61 for damping purposes. The layers are wound alternately in right-handed and left-handed helices.

The geometry of the conductor is defined by the following parameters, using the same symbols as have been used in the preceding examples:

| | | |
|---|---|---|
| ($A_1$) | 111 | sq. mm. |
| ($D_1$) | 12.33 | mm. |
| ($l_1$) | 210 | mm. |
| ($\theta_1$) | 10.45 | degrees |
| ($A_2$) | 227 | sq. mm. |
| ($D_2$) | 19.41 | mm. |
| ($l_2$) | −240 | mm. |
| ($\theta_2$) | −14.26 | degrees |
| ($A_3$) | 161 | sq. mm. |
| ($D_3$) | 25.58 | mm. |
| ($l_3$) | 385 | mm. |
| ($\theta_3$) | 11.79 | degrees |
| (d) | 27.74 | mm. |

Applying the formulae discussed previously, one finds that for this conductor the resultant axial magnetic field in the steel core is given by $$H = \frac{A_1}{l_1} + \frac{A_2}{l_2} + \frac{A_3}{l_3} = .0009 \text{ mm.}$$

Furthermore, the unbalanced torque is reduced to 0.06 times the cube of the conductor diameter.

In each of the above examples the electrical properties of the conductor are expressed as a factor H, which is the magnitude of the axial magnetic field (in millimeters) produced in the steel core. As previously noted, this corresponds to the actual magnetic field in amperes/millimeter for a uniform current density of 1 ampere/square millimeter. The lower this magnetic field factor is, the lower will be the power losses in the conductor.

Also, in each of the above examples, the mechanical properties of the conductor are expressed as the quotient of unbalanced torque, measured in millimeters cubed, divided by the cube of the conductor diameter in millimeters. This quotient should be as small as possible and ideally should be zero.

The ACSR conductors described in Examples 1, 3 and 5 are commercially available conductors designed according to conventional standards. As in all current designs, the electrical and mechanical properties of such conductors are less than optimal. However, as the remaining examples show, by modifying the lay factors of the strand layers to meet the design criteria previously discussed herein, one can greatly improve the electrical and mechanical properties of the conductor. Since these properties depend respectively on different design criteria, it may not always be possible to eliminate both axial magnetic field and unbalanced torque at the same time without resorting to new ACSR conductor configurations such as those illustrated in FIGS. 6 and 7 and described in Examples 8 and 9. In general it is simpler to reduce the axial magnetic field factor for a two-layer conductor than for an ACSR conductor having three or more layers. In the case of a two-layer ACSR conductor, the required improvement in electrical properties is achieved if the magnetic field factor is reduced to 0.1 or less. In the case of a three-layer ACSR conductor, or a conductor having more than three-layers, a significant improvement over existing designs is achieved if the magnetic field factor is reduced to 0.25 or less.

On the other hand, it is generally simpler to reduce the unbalanced torque factor in an ACSR conductor having three or more layers than in a two-layer conductor. In the case of a two-layer ACSR conductor a significant improvement over existing designs is achieved if the unbalanced torque factor is reduced to 1.5 or less. However, in the case of an ACSR conductor having three or more layers it is feasible to achieve a significant improvement over existing designs by reducing the unbalanced torque factor to 1.0 or less. In the case of a three-layer ACSR conductor, although the unbalanced torque factor can be reduced to less than 1.0 by modifying the lay factors of the conductor layers, such modification will not always be consistent with optimization of the magnetic field factor if the modification is kept within accepted conductor standards. However, this difficulty can be overcome, as illustrated by Examples 8 and 9, by adopting an ACSR configuration wherein the radial thicknesses of the conductor layers are suitably different. Thus, in each of the conductors of Exampl 8 and 9, the radial thicknesses of adjacent layers differ by more 10%.

The general configuration of the ACSR conductor may be varied in numerous ways to facilitate appropriate selection of the lay factors of the conductor layers while keeping them within accepted conductor standards. For example, in the case of a three-layer conductor the innermost and intermediate layers may be wound in the same direction, the outermost layer being wound in the opposite direction. In another variant the strands of the innermost and outermost layers are of round cross section while the strands of the intermediate layer are of trapezoidal cross section. This variant is illustrated in FIG. 8, in which the three layers are wound around a steel core 70, the conductor strands of the inner layer 71 and of the outer layer 73 being of round cross section, and the conductor strands of the intermediate layer being of trapezoidal cross section. A variant of the two-layer conductor is illustrated in FIG. 9, in which the two layers are wound around a steel core 80, the conductor strands of the inner layer 81 being f trapezoidal cross-section and the conductor strands of the outer layer 82 being of round cross section. As in the embodiment shown in FIG. 4, a clearance 83 is left between the steel core and the inner layer.

We claim:

1. An ACSR conductor having three or more layers of aluminum conductor strands helically wound around a steel core, the layers being wound alternately in right-handed and left-handed helices, wherein the lay lengths and conductor cross sectional areas of the layers are such that $$\left| \sum_{i=1}^{n} \frac{A_i}{l_i} \right| \leqq .25 \text{ mm.}$$

where $A_i$ is the conductor cross sectional area in square millimeters, and $l_i$ is the lay length in millimeters, of a respective layer i, $l_i$ being positive for a right-handed helically wound layer and negative for a left-handed helically wound layer, and n being the number of layers.

2. An ACSR conductor according to claim 1, wherein the radial thicknesses of any two adjacent layers differ by more than 10%.

3. An ACSR conductor according to claim 1, wherein the conductor cross sectional areas of the layers, the lay angles of the layers, and the mean diameters of the layers are such that the magnitude of unbalanced torque, measured in millimeters cubed, is less than or equal to the cube of the conductor diameter, measured in millimeters.

4. An ACSR conductor according to claim 3, wherein the radial thicknesses of any two adjacent layers differ by more than 10%.

5. An ACSR conductor according to claim 1, having three conductor layers, wherein the strands of the innermost and outermost layers are of round cross section and the strands of the intermediate layer are of trapezoidal cross section.

6. An ACSR conductor having three layers of aluminum conductor strands helically wound around a steel core, the innermost and intermediate layers being helically wound in the same direction and the outermost layer being helically wound in the opposite direction, wherein the lag lengths and conductor cross sectional areas of the layers are such that $$\left| \sum_{i=1}^{n} \frac{A_i}{l_i} \right| \leqq .25 \text{ mm}$$

where Ai is the conductor cross sectional area in square millimeters, and li is the lay length in millimeters, of a respective layer i, li being positive for a right handed helically wound layer and negative for a left handed helically wound layer, and n being the number of layers.

7. An ACSR conductor having two layers of aluminum conductor strands helically wound around a steel core, one layer being wound in a right-handed helix and the other layer being wound in a left-handed helix, wherein the conductor cross sectional areas $A_1$, $A_2$ of the layers in square millimeters and the lay lengths $l_1$, $l_2$ of the layers in millimeters are such that $$\left| \frac{A_1}{l_1} + \frac{A_2}{l_2} \right| \leqq .10 \text{ mm.,}$$

$l_1$ and $l_2$ being of opposite sign.

8. A two-layer ACSR conductor according to claim 7, wherein the radial thicknesses of the layers differ by more than 10%.

9. A two-layer ACSR conductor according to claim 7, wherein the conductor cross sectional areas of the layers, the lay angles of the layers, and the mean diameters of the layers are such that the magnitude of unbalanced torque in millimeters cubed is less than or equal to 1.5 times the cube of the conductor diameter measured in millimeters.

10. A two-layer ACSR conductor according to claim 9, wherein the radial thicknesses of the layers differ by more than 10%.

11. A two-layer ACSR conductor according to claim 7, wherein the conductor strands of the inner layer are of trapezoidal cross section and the conductor strands of the outer layer are of round cross section.

* * * * *